US006070619A

United States Patent [19]

Tamura et al.

[11] Patent Number: 6,070,619

[45] Date of Patent: Jun. 6, 2000

[54] EASING ROLLER CONTROL METHOD

[75] Inventors: Zenji Tamura; Kenjiro Ohno, both of Kanazawa, Japan

[73] Assignee: Tsudakoma Kogyo Kabushiki Kaisha, Ishikawa-Ken, Japan

[21] Appl. No.: 09/307,726

[22] Filed: May 10, 1999

[30] Foreign Application Priority Data

May 11, 1998 [JP] Japan ..... 10-145063

[51] Int. Cl.[7] ..... D03D 49/12; D03D 49/04

[52] U.S. Cl. ..... 139/100; 139/103; 139/104; 139/105; 139/108; 139/109; 139/110

[58] Field of Search ..... 139/1 R, 109, 139/110, 100, 103, 104, 105, 108; D03D 49/12, 49/04

[56] References Cited

U.S. PATENT DOCUMENTS

| | | | |
|---|---|---|---|
| 4,827,985 | 5/1989 | Sugita et al. | 139/25 |
| 4,949,759 | 8/1990 | Takegawa et al. | 139/25 |
| 5,261,463 | 11/1993 | Sato | 139/1 R |

FOREIGN PATENT DOCUMENTS

| | | | |
|---|---|---|---|
| 6-1097450 | 5/1986 | Japan | 139/110 |
| 6-2238846 | 10/1987 | Japan | 139/110 |
| 4-24244 | 1/1992 | Japan . | |
| 7-238443 | 9/1995 | Japan . | |

*Primary Examiner*—John J. Calvert
*Assistant Examiner*—Robert H. Muromoto, Jr.
*Attorney, Agent, or Firm*—Wenderoth, Lind & Ponack, L.L.P.

[57] ABSTRACT

A method of controlling the easing motion (1) of a loom executes a position control operation and a tension control operation successively in one weaving cycle of the loom. The position of an easing roller (6) included in the easing motion (1) is measured in a position control period, a correction is determined according to the deviation of the measured position of the easing roller (6) from a desired roller position, and a controlled variable is corrected by using the correction to make the actual position of the easing roller (6) approach the desired roller position.

14 Claims, 3 Drawing Sheets

EASING ROLLER CONTROL METHOD

BACKGROUND OF THE INVENTION

1. Field of the Invention

The present invention relates to a method of controlling an easing roller included in a loom to execute selectively a position control operation or a tension control operation by an easing motion.

2. Description of the Related Art

An easing roller control method disclosed in JP-A No. 4-24244 controls the position of an easing roller by supporting each end of the easing roller for rotation on each free end of a pair of arms fixed to the output shaft of a drive motor, and controlling the turning angle of the output shaft of the drive motor. When a let-off tension control period is ended and an easing control period is started, the mode of control operation for controlling the drive motor is changed from a tension control mode to a position control mode. The easing roller is shifted by a desired distance set by operating a setting device toward the cloth fell at the beginning of the easing control period. The position of the easing roller thus determined at the beginning of the easing control period is dependent on the position of the easing roller determined for tension control in the tension control period preceding the easing control period. Thus, the position of the easing roller at the beginning of the easing control period varies for each weaving cycle of the loom; that is, the most advanced position of the easing roller, which, generally, is the position of the easing roller at a beating-up moment when the phase of the main shaft of the loom is 0°, varies for each weaving cycle of the loom. Thus, it is possible that the easing roller is required to move to an unexpected position depending on the condition of tension control and cannot be shifted to that required position, and satisfactory tension control cannot be achieved.

An easing motion disclosed in JP-A No. 7-238443 uses a cam mechanism to drive an easing roller for easing warp yarns for forming satin stripes. This prior art easing motion is free from disadvantages of the above-mentioned easing motions. Since the warp tension is dependent on the cam contour of a cam included in the cam mechanism, it is virtually impossible to adjust the actual warp tension to a desired warp tension because the operation of a control system is disturbed by disturbance and the warp tension varies.

SUMMARY OF THE INVENTION

Accordingly, it is an object of the present invention to provide an easing motion employing a servomotor, capable of positioning an easing roller always in a predetermined positional range and of easily achieving tension control and position control.

An easing roller control method according to the present invention moves an easing roller forward to a predetermined position in a position control period including a beating-up moment in one weaving cycle of a loom by driving a servomotor for position control to give warp yarns on the loom a predetermined first tension, and moves the easing roller backward in a tension control period including a moment when a maximum shed is formed by driving the servomotor for tension control to give the warp yarns a predetermined second tension higher than the first tension for the position control period.

According to a first aspect of the present invention, an easing roller control method comprises the steps of measuring the position of an easing roller included in a loom in a position control period, determining a correction according to a deviation of a measured position from a desired roller position, and correcting a controlled variable for position control by using the correction to make the actual position of the easing roller approach the desired roller position.

According to a second aspect of the present invention, an easing roller control method comprises the steps of measuring the position of an easing roller included in a loom in a tension control period, determining a correction according to the deviation of a measured position from a desired roller position, and correcting a controlled variable for tension control by using the correction to make the actual position of the easing roller approach the desired roller position.

According to a third aspect of the present invention, an easing roller control method comprises the steps of measuring the position of an easing roller included in a loom in a tension control period, determining a correction according to the deviation of a measured position from a desired roller position, and correcting a controlled variable for position control by using the correction upon transition from the tension control period to a position control period to make the actual position of the easing roller approach the desired roller position.

According to a fourth aspect of the present invention, an easing roller control method comprises the steps of measuring the position of an easing roller included in a loom in a position control period, determining a correction according to the deviation of a measured position from a desired roller position, and correcting a controlled variable for tension control by using the correction upon transition from the position control period to a tension control period to make the actual position of the easing roller approach the desired roller position.

In the position control period or the tension control period, the actual position of the easing roller is measured, and a control signal (a current) for position control or tension control is corrected according to the deviation of the measured position from the desired roller position. Thus, the servomotor is controlled properly to make the easing roller approach the desired roller position in the position control period, and the displacement of the easing roller to an unexpected position due to improper tension control in the tension control period can be prevented.

When the control period is altered from the tension control period to the position control period, a correction signal is corrected on the basis of a desired value for position control. Consequently, the position of the easing roller is adjusted accurately to the desired roller position by position control. When the control period is altered from the position control period to the tension control period, the correction for position control is used to correct a command value for tension control. Therefore, the easing roller is controlled so as to move moderately according to the correction when the control period is altered from the position control period to the tension control period to prevent the momentary tension rise by suppressing the inertial force of the easing roller.

The position of the easing roller can automatically be corrected by changing the position of a position transducer. For example, the foremost position can automatically be made to coincide with a sensor position if a sample signal is generated at a phase of 0°.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
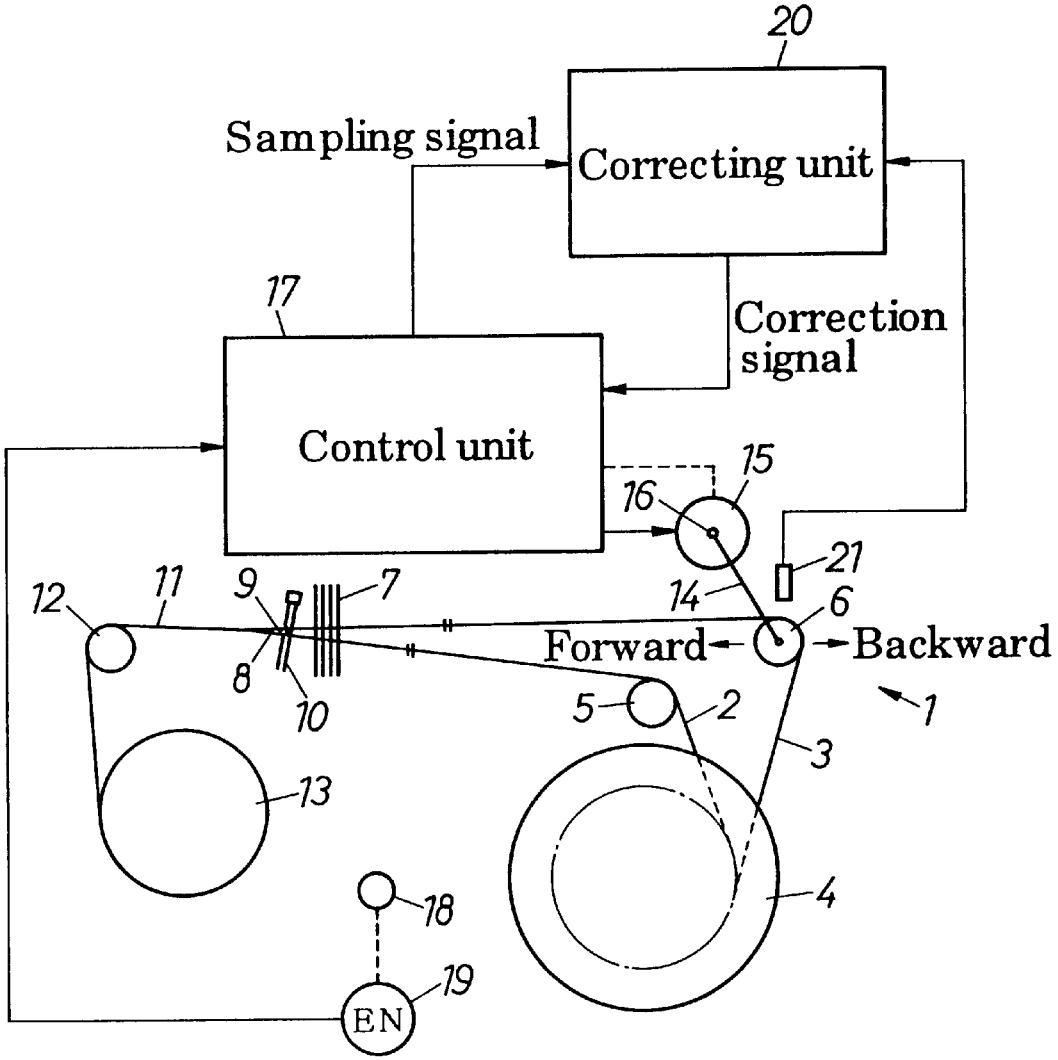
FIG. 1 is a schematic side elevation of an easing motion for carrying out an easing roller control method according to the present invention.

FIG. 1 shows an easing motion 1 for carrying out an easing roller control method according to the present invention in easing warp yarns for satin stripes. Ground warp yarns 2 and satin stripe warp yarns 3 are wound on a warp beam 4. The ground warp yarns 2 and the satin stripe warp yarns 3 are wound round easing rollers 5 and 6, respectively. The ground warp yarns 2 and the satin stripe warp yarns 3 are passed through the eyes of heddles held on heddle frames 7. The heddle frames are moved vertically to form a shed 8. Weft yarns 9 are inserted into sheds 8, interlaced with the ground warp yarns 2 and the satin stripe warp yarns 3, and beaten up by a reed 10 to form a fabric 11. The fabric 11 is taken up through a breast beam 12 by a take-up beam 13.

The easing roller 6, i.e., a controlled member, has both ends supported for rotation on the free ends of a pair of arms 14. The pair of arms 14 are able to swing forward and backward to move the easing roller 6 forward and backward. Each of the arms 14 has a base end part fixed to an arm shaft coupled with the output shaft 16 of a servomotor 15 for controlling the position of the easing roller 6. The output shaft 16 of the servomotor 15 is turned either forward or backward through a predetermined angle in one weaving cycle, in which a main shaft 18 included in the loom makes one full turn, for position control in a position control period including a beating-up moment and for tension control in a tension control period including a moment when a maximum shed is formed.

A control unit 17 receives a phase signal provided by an encoder 19 associated with the main shaft 18 and a correction signal from a correcting unit 20, and controls the servomotor 15. The correcting unit 20 compares the position of the easing roller 6 measured by a position transducer 21 with a desired roller position, and gives a correction signal representing the deviation of the measured position from the desired roller position to the control unit 17.

Figure 2:
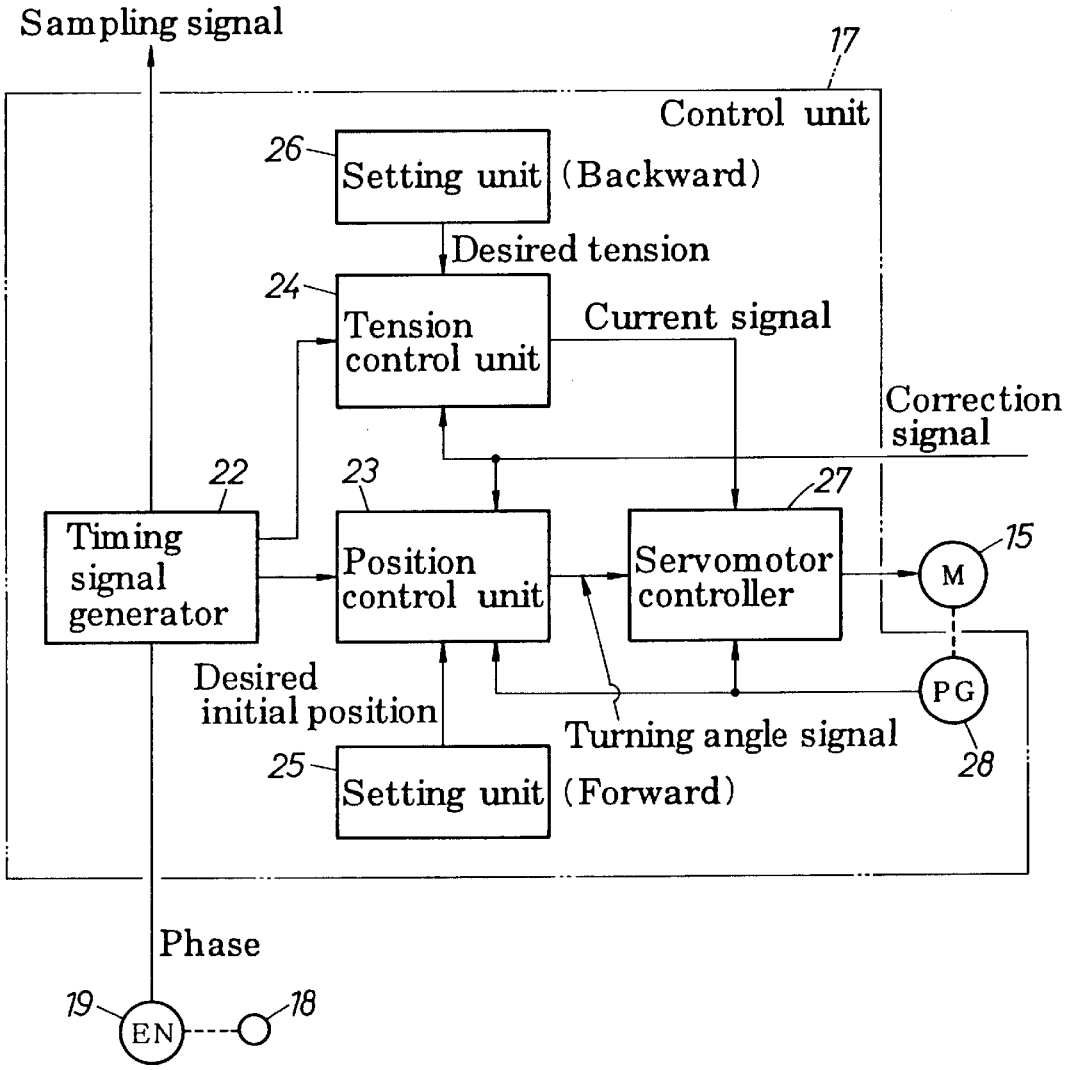
FIG. 2 is a block diagram of a control unit.

Referring to FIG. 2 showing the control unit 17, a timing signal generator 22 receives a phase signal provided by the encoder 19, and gives a timing signal to a position control unit 23 and a tension control unit 24 at regular intervals of, for example, 5 in the turning angle of the main shaft 18. The timing signal generator 22 generates also a sampling signal at a predetermined phase of the main shaft 18, and gives the sampling signal to the correcting unit 20. The timing signal generator 22 actuates a position control unit 23 in a position control period including a beating-up moment, and actuates a tension control unit 24 in a tension control period including a moment when a maximum shed is formed.

In the position control period, the position control unit 23 generates a turning angle command signal on the basis of both input data on a desired roller position for the easing roller 6 corresponding to a phase set by a setting unit 25 and the timing signal given thereto to drive a servomotor controller 27. The servomotor controller 27 controls the servomotor 15 to turn the output shaft 16 of the servomotor 15 in a forward direction to shift the easing roller 6 to a front end position. The tension control unit 24 generates a tension control signal representing a current corresponding to a desired tension on the basis of both input data on the desired tension corresponding to a phase set by a setting unit 26 and the timing signal given thereto to drive the servomotor controller 27. The servomotor controller 27 controls the servomotor 15 to turn the output shaft 16 of the servomotor 15 in a backward direction by a torque corresponding to the desired tension to give the satin stripe warp yarns 3 the desired tension. A pulse generator 28 measures an angle through which the output shaft 16 of the servomotor 15 is turned and gives an angle signal representing the angle through which the output shaft 16 is turned as a feedback signal to the position control unit 23 and the servomotor controller 27.

Figure 3:
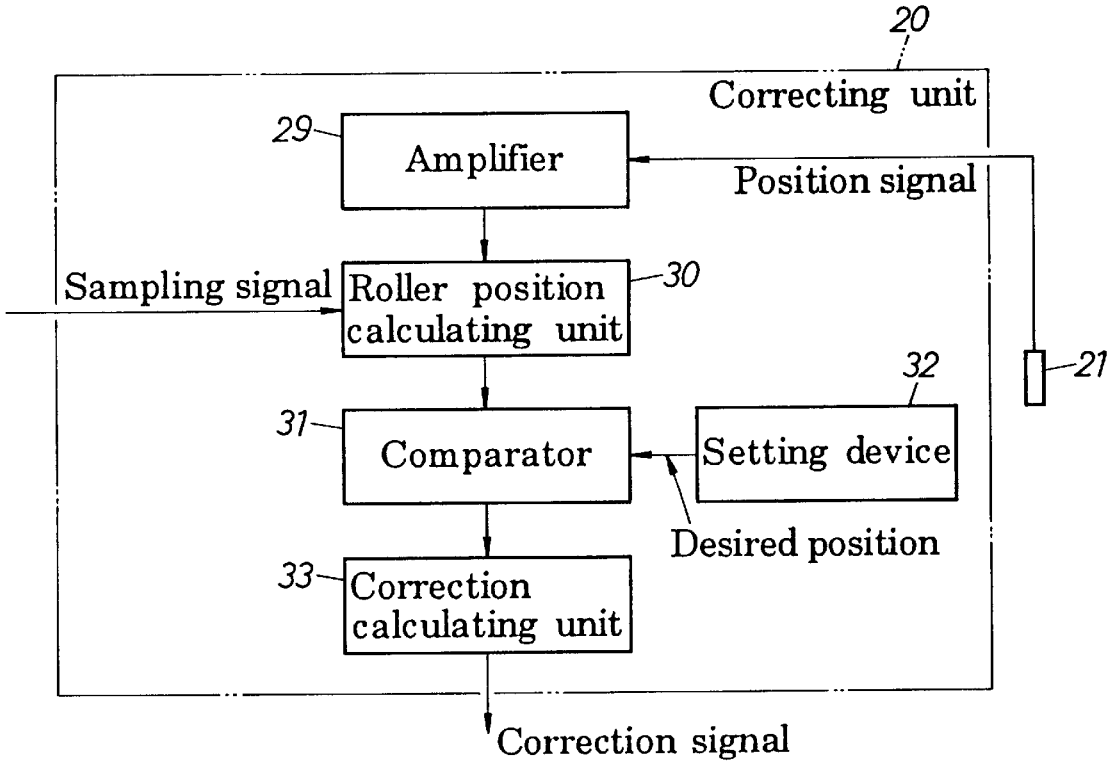
FIG. 3 is a block diagram of a correcting unit.

Referring to FIG. 3 showing the correcting unit 20, a position signal generated by the position transducer 21 is amplified by an amplifier 29, and the amplified position signal is given to a roller position calculating unit 30. The roller position calculating unit 30 detects or calculates the position of the easing roller 6 every time a sampling signal is given thereto. The sampling signal is generated when the main shaft 18 is at a phase of, for example, 0° or 180°. The roller position calculating unit 30 gives data on a calculated roller position to a comparator 31. The comparator 31 compares the data on the calculated roller position with a desired roller position data corresponding to a sampling phase and given thereto by the setting unit 32, and gives a deviation signal representing the deviation of the calculated roller position from the desired roller position to a correction calculating unit 33. The correction calculating unit 33 gives a correction signal corresponding to the deviation at least to the position control unit 23 or the tension control unit 24.

Figure 4:
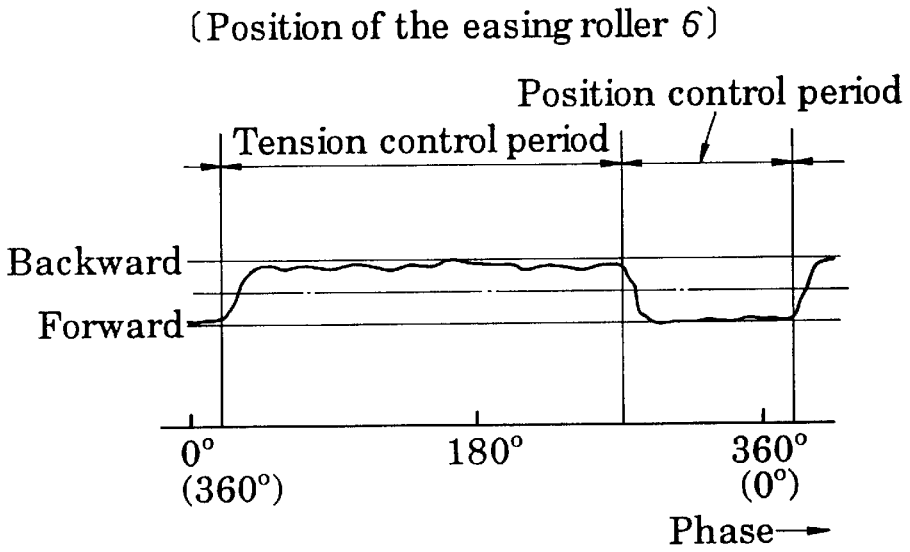
FIG. 4 is a diagram of assistance in explaining the variation of the position of an easing roller in a tension control period and a position control period included in one weaving cycle.

Referring to FIG. 4, a weaving cycle, i.e., a period in which the main shaft 18 of the loom makes one full turn, has a position control period and a tension control period. The position control period corresponds to a phase range of, for example, 270° to 20° including a beating-up moment corresponding to a phase of 0°. The tension control period corresponds to a phase range of, for example, 20° to 270° including a phase angle of, for example, 180° when a maximum shed is formed. A position control operation is executed in the position control period to reduce the tension of the satin stripe warp yarns 3 by moving the easing roller 6 forward by the servomotor 15 to a level below a tension set by a tension control operation. The tension control operation is executed in the tension control period to increase the tension of the satin stripe warp yarns 3 to a level above the tension set by the position control operation. Thus, the easing roller 6 is moved forward and backward by the servomotor 15.

In the position control period, the position control unit 23 reads a position for the easing roller 6 corresponding to a timing signal given thereto on the basis of data on the position of the easing roller 6 when the main shaft 18 is at a phase set by the setting unit 25, gives a turning angle signal representing the position for the easing roller 6 to the servomotor controller 27. Then, the servomotor controller 27 drives the servomotor 15 to turn the output shaft 16 of the servomotor 15 in the predetermined direction to move the easing roller 6 forward.

In some cases the actual front end position of the easing roller 6 is dislocated from a desired position due to the malfunction of the control system of the loom caused by a disturbance or the undesired variation of warp tension. According to the invention as disclosed in claim 1, the correcting unit 20 generates a correction signal representing a correction on the basis of the comparison between a position signal provided by the position transducer 21 and a desired position signal and gives the correction signal to the position control unit 23. The position signal is provided by the position transducer 21 in response to the sampling signal generated every sampling period corresponding to one revolution or ten revolutions of the main shaft 18 of the loom. The desired position signal is set in advance by a setting device 32. Then, the position control unit 23 corrects the phase of the output shaft 16 of the servomotor 15 on the basis of the correction signal to shift the easing roller 6 to the desired position. Thus, the position control unit 23 executes the position control operation in the position control period to correct the position of the easing roller 6 at the sampling period.

In the tension control period, the tension control unit 24 generates a current signal representing a current corresponding to a timing signal given thereto on the basis of data on a desired tension corresponding to a phase of the main shaft 18 set by the setting unit 26, and gives the current signal to the servomotor controller 27. The servomotor controller 27 drives the output shaft 16 of the servomotor 15 for turning in a direction suitable for making the torque of the servomotor 15 and the tension of the satin stripe warp yarns 3 balance each other. Consequently, the easing roller is moved backward to adjust the tension of the satin stripe warp yarns 3 to the desired tension. Further, according to the invention as disclosed in claim 2, the correcting unit 20 generates the correction signal representing the correction on the basis of the comparison between the position signal provided by the position transducer 21 and the desired position signal and gives the correction signal to the tension control unit 24. The position signal is provided in response to the sampling signal generated every sampling period at a phase of 180° of the main shaft 18 in the tension control period, and gives the correction signal to the tension control unit 24. Accordingly, the tension control unit 24 corrects the current represented by the current signal given to the servomotor 15 and corresponding to the output torque of the servomotor 15 to reduce the tension when the easing roller 6 is moved excessively forward Thus, the easing roller 6 can always be moved to a fixed front end position, and the displacement of the easing roller 6 to an unexpected position in the tension control period can be avoided.

Although the correcting unit 20 gives a correction signal for the tension control period to the tension control unit 24 according to the invention disclosed in claim 2, it gives the same correction signal to the position control unit 23 when the tension control period is terminated and the position control period is started according to the invention as disclosed in claim 3. Accordingly, the position control unit 23 generates, for the position control period, a control signal representing a turning angle corresponding to the displacement of the easing roller 6 in the tension control period More specifically, correction is made so that the position is behind the desired position, when the easing roller 6 is moved excessively forward Accordingly, the position of the easing roller 6 in the initial stage of the position control period is not affected by the displacement of the easing roller 6 in the preceding tension control period, and the easing roller 6 is moved accurately to the desired position (front end position).

According to the invention as disclosed in claim 4, since the correcting unit 20 gives a correction signal for the position control period to the tension control unit 24 when the position control period is terminated and the tension control period is started, the tension control unit 24 regulates the rotating speed of the output shaft 16 of the servomotor 15, i.e., the speed of movement of the easing roller 6 from the front position to a back position so that the easing roller 6 moves at a moderate speed to suppress the effect of the inertia of the easing roller 6 on the variation of the warp tension so that the warp tension may not rise momentarily and to avoid the backward movement of the easing roller 6 beyond a desired position.

When weaving the satin stripe fabric on the loom, generally, the satin stripe warp yarns 3 are loosened, and ground warp yarns 2 are tightened due to the difference of the textile weave. But, when the position control and the tension control are executed alternately for the satin stripe warp yarns 3, the ground warp yarns 2 and the satin stripe warp yarns 3 are in the same tension. The present invention is applicable not only to the control of the easing roller 6 for easing the satin stripe warp yams, but also to the control of the easing roller 5 for easing the ground warp yarns 2 and to the control of the easing rollers of looms for weaving fabrics of ordinary weaves.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A method of controlling an easing roller of a loom, wherein the loom comprises the easing roller, a warp beam, and a servomotor for moving the easing roller in forward and backward directions, wherein satin stripe warp yarns are wound around the warp beam and wound around the easing roller, and ground warp yarns are wound around the warp beam and wound around a roller separate from the easing roller, said method comprising:

driving the servomotor during a position control period of a weaving cycle to move the easing roller forward to a predetermined position so as to provide the satin stripe warp yarns with a predetermined first tension, wherein the position control period includes a beating-up moment;

driving the servomotor during a tension control period of the weaving cycle to move the easing roller backward so as to provide the satin stripe warp yarns with a predetermined second tension greater than the first tension, wherein the tension control period includes a maximum shed formation moment; and controlling said driving of the servomotor during a position control period and said driving of the servomotor during a tension control period, said controlling comprising:

(A) measuring periodically an actual position of the easing roller;

(B) determining a correction distance based on a difference between a desired easing roller position and the actual position; and (C) correcting a controlled variable based upon the correction distance, wherein the corrected controlled variable is used to control at least one of said driving of the servomotor during a position control period and said driving of the servomotor during a tension control period to move the easing roller such that the actual position of the easing roller at least approaches the desired easing roller position.

2. The method of claim 1, wherein said periodic measuring occurs during the position control period, and the controlled variable comprises a controlled variable for position control of the easing roller.

3. The method of claim 1, wherein said periodic measuring occurs during the tension control period, and the controlled variable comprises a controlled variable for tension control of the easing roller.

4. The method of claim 1, wherein said periodic measuring occurs during the tension control period, the controlled variable comprising a controlled variable for position control of the easing roller, and wherein the corrected controlled variable is used in controlling said driving of the servomotor upon transition from the tension control period to the position control period.

5. The method of claim 1, wherein said periodic measuring occurs during the position control period, the controlled variable comprising a controlled variable for tension control of the easing roller, and wherein the corrected controlled variable is used in controlling said driving of the servo motor upon transition from the position control period to the tension control period.

6. The method of claim 1, wherein said measuring comprises measuring the actual position of the easing roller using a position transducer.

7. The method of claim 1, wherein said controlling of said driving of the servomotor further comprises:

generating a timing signal based on a rotation position of a main shaft of the loom; and actuating a position control unit when the timing signal corresponds to a position control period, and actuating a tension control unit when the timing signal corresponds to a tension control period.

8. The method of claim 7, wherein when the position control unit is actuated, said controlling of said driving of the servomotor further comprises:

generating a feedback signal based on a turning angle of the servomotor and transmitting the feedback signal to the position control unit;

generating a turning angle signal in the position control unit based on the feedback signal, a desired position setting, and a correction signal corresponding to the correction distance; and transmitting the turning angle signal to the servomotor so as to move the easing roller in accordance with the turning angle signal.

9. The method of claim 7, wherein when the tension control unit is actuated, said controlling of said driving of the servomotor further comprises:

generating a tension control signal in the tension control unit based on a desired tension setting and a correction signal corresponding to the correction distance; and transmitting the tension control signal to the servomotor so as to move the easing roller in accordance with the tension control signal.

10. A method of controlling an easing roller of a loom, comprising:

driving a servomotor connected to the easing roller so as to move the easing roller in one of a first direction, wherein satin stripe warp yarns on the loom are provided with a first tension, and a second direction opposite the first direction, wherein the satin stripe warp yarns on the loom are provided with a second tension greater than the first tension;

measuring periodically an actual position of the easing roller;

generating a correction signal based on a difference between a desired easing roller position and the actual position of the easing roller;

generating a driving signal based on the correction signal and one of a desired position setting and a desired tension setting; and transmitting the driving signal to the servomotor to move the easing roller such that the actual position of the easing roller at least approaches the desired easing roller position.

11. The method of claim 10, wherein said measuring comprises measuring the actual position of the easing roller using a position transducer.

12. The method of claim 10, further comprising:

generating a timing signal based on a rotation position of a main shaft of the loom; and actuating a position control unit when the timing signal corresponds to a position control period, and actuating a tension control unit when the timing signal corresponds to a tension control period.

13. The method of claim 12, further comprising generating a feedback signal based on a turning angle of the servomotor, wherein when the position control unit is actuated, said generating of the driving signal is based on the correction signal, the desired position setting, and the feedback signal.

14. The method of claim 12, wherein when the tension control unit is actuated, said generating of the driving signal is based on the correction signal and the desired tension setting.

* * * * *